United States Patent [19]

Lezgintsev et al.

[11] 3,983,707

[45] Oct. 5, 1976

[54] METHOD AND APPARATUS FOR MOVING AN OBJECT ON THE BOTTOM OF A BODY OF WATER

[76] Inventors: Georgy Mikhailovich Lezgintsev, Leninsky prospekt, 36, kv. 250; Vladimir Ivanovich Popov, Podsosensky pereulok, 11, kv. 14; Stanislav Jurievich Istoshin, Koptevskaya ulitsa, 26, korpus 3, kv. 69; Mikhail Anatolievich Belyavsky, ulitsa Butlerova, 10, kv. 61, all of Moscow; Igor Nikolaevich Stashevsky, ulitsa Sosnovaya, 8, kv. 23, Podolsk Moskovskoi oblasti; Igor Parfenovich Timofeev, ulitsa Chaikovskogo, 79, kv. 39, Leningrad, all of U.S.S.R.

[22] Filed: Mar. 5, 1975

[21] Appl. No.: 555,619

[52] U.S. Cl. ..... 61/69 R; 37/56; 115/9

[51] Int. Cl.[2] ..... B25J 3/00; B63C 11/00; E02F 5/28

[58] Field of Search ..... 61/69 R, 72.4, 46.5; 37/56, 54; 115/9; 114/16

[56] References Cited

UNITED STATES PATENTS

| | | | |
|---|---|---|---|
| 1,134,708 | 4/1915 | Watkins | 115/9 |
| 2,602,300 | 7/1952 | Collins | 61/72.4 |
| 2,612,759 | 10/1952 | Haward | 61/46.5 |
| 3,550,386 | 12/1970 | Ballinger | 61/69 R |
| 3,675,607 | 7/1972 | Dorschel | 61/69 R |
| 3,812,804 | 5/1974 | Najagata et al. | 61/69 R |

*Primary Examiner*—Jacob Shapiro
*Attorney, Agent, or Firm*—Haseltine, Lake & Waters

[57] ABSTRACT

A method for moving an object on the bottom of a body of water comprising producing a positive buoyancy in the region of one of the supports of the object to lift the support from the bottom of the body of water and then turning the object in the desired direction around another of the supports which remains at rest on the bottom of the body of water. Upon completion of the turning movement of the object, the raised support is lowered by producing a negative buoyancy in the region of such support. The positive and negative buoyancy is produced by means of gas and water pumped into containers mounted in the region of the supports.

14 Claims, 10 Drawing Figures

METHOD AND APPARATUS FOR MOVING AN OBJECT ON THE BOTTOM OF A BODY OF WATER

The present invention relates to methods of movement of walking mechanisms and more particularly to methods of movement over the bottom of water bodies such as seas and devices for the realization thereof.

The present invention can be utilized most efficiently for underwater research and extraction of sea and ocean mineral deposits.

Known in the art is a method of movement of a walking mechanism consisting in that said mechanism is lifted then turned in the required direction relative to one of the supports which rests on a bearing surface at the moment of turning.

The device for the realization of said method comprises a frame provided with supports the distance between which is less than the total length of the frame. Moving throughout the length of the frame is a carriage with an extracting or information element, the mass of the carriage being selected so that the travel of the carriage beyond the supports would create a moment required for lifting and turning the device in the required direction relative to one of the supports. The device is provided with a mechanism for turning it in the required direction.

A considerable disadvantage of the above-described method and device for the realization thereof lies in that the lifting and turning of the device relative to one of its supports calls for bringing the center of gravity of the device beyond the support around which the turn is made. A part of the frame should be located beyond the limits of the supports which impairs the reliablity of movement of the device all the more so on a rough bottom surface because the part of the frame protruding beyond the support may come to bear against the bottom surface while the device is being lifted and may even get bogged down.

Another disadvantage of said device is that the mass of the carriage should correspond to that of the frame an extracting or another element which makes the carriage and the entire device considerably heavier.

Known in the art are various wheeled, crawler and walking (e.g. excavator type) mechanisms specially employed for underwater movement over the bottom surface.

These mechanisms carry extracting or information elements for exploring and working the bottom.

However, these mechanisms utilizing the principles of movement of land vehicles and provided with electric or hydraulic drives have to be hermetically sealed which complicates their design, reduces their reliability and increases operating costs.

In addition, a common disadvantage of these mechanisms is their poor passability over the rough bottom aggravated by a lack of visibility required for their control, especially in the zone of underwater working.

The extraction elements in these mechanisms are constituted by various devices in the form of cutting blades, buckets, rotors, etc. as well as by hydraulic and pneudraulic suction devices, such as dredge and jet pumps.

As information elements can be used television cameras, soil samplers, etc.

An object of the present invention is to eliminate the aforesaid disadvantages.

Another object of the present invention is to provide a method of movement which will ensure travelling of a machine over the bottom of water bodies of various topography in poor visibility under the water.

Another object of the present invention is to provide a machine for travelling over the bottom of water bodies which is simple in design and control.

Still another object of the present invention is to provide a machine for travelling over the bottom of water bodies which will have a minimum possible weight.

In addition, another object of the present invention is to provide a machine for travelling over the bottom of water bodies which will yield itself easily to transportation towards the zone of its employment.

These and other objects are accomplished by providing a method of movement of machines over the bottom of water bodies consisting in lifting and turning the machine in the required direction relative to one of its supports which rests at the moment of turning on the bottom surface wherein, according to the invention, the machine is turned in the required direction relative to the support resting on the bottom surface by building up a positive buoyancy in the zone of the turned support while after completion of the turn a negative buoyancy is built up in the same zone.

In the method according to the invention, each support is lifted for turning the machine in the required direction by building up a positive buoyancy in its zone and thereby producing a buoyant force which lifts the machine above the bottom surface.

After the machine has been turned around the opposite support, a negative buoyancy is created in the first support and the latter takes a new position on the bottom. By lifting the machine and turning it relative to one of the supports in the required sequence it is possible to obtain various trajectories of the travel of the machine.

The invention allows the machine to travel over various kinds of bottom surface including rough topography, in poor visibility under the water.

The device for the realization of the method according to the invention comprises a frame with supports and a mechanism for turning the machine relative to the supports has, according to the invention, containers in the zone of the supports, communicating through pipes with the source of a working medium for building up a positive or negative buoyancy in each support.

By filling the container with the working medium whose specific gravity is lower than that of the medium around the machine (This ambient medium will be referred to hereinafter as "water") it is possible to build up a positive buoyancy and the buoyant force required for lifting the machine. After turning the machine in the required direction relative to the support which rests at the moment of turning on the surface of the bottom, the container is filled with water, the machine in the zone of the lifted support acquires a negative buoyancy and takes a new position on the surface of the bottom.

The supports are articulated to the frame. This ensures stability and allows the machine to move together with the working element (extracting, drilling or information) irrespective of the bottom topography within the required parameters and ensures the requisite contact of the working element with the bottom surface. This dispenses with the need for preliminary reconnaisance of the bottom topography which means that the work can be carried on in poor visibility that is characteristic of underwater working of soils.

The working elements can be fixed to the frame or travel over it on a sliding carriage. For geological prospecting in given squares the drilling equipment can be installed in a stationary way at one or more points on the machine frame.

When the working elements of the machine function as extracting elements, it is expedient that the latter be mounted on a sliding carriage. The extracting elements may be constituted by slush and jet pumps in combination with mechanical or hydraulic rippers.

The machine for the realization of the proposed method is simple in design and control and is light in weight.

The possibility of building up a positive buoyancy in the zone of the supports allows the machine to be easily and safely transported by water to the zone of operation.

Additionally, if the buoyancy is changed by ballasting, it is possible to lower the machine to the bottom and lift it without additional load-hoisting equipment of the service vessel.

The containers can be made as an integral element of the machine frame which will considerably reduce the weight of the machine.

The working medium can be a gas, e.g. air which ensures positive buoyancy in the zone of the supports and cheapness of operation.

The gas, e.g. compressed air, can be repeatedly used and pumped from one container into another while shifting over from the positive to the negative buoyancy.

In another embodiment of the machine, the gas released from the container can be used for hydraulic transport of the mineral deposits excavated from the bottom. For example, in the air-lift hydraulic method of recovering the mineral deposits an important advantage lies in the epployment of one and the same working medium, compressed gas or air, for moving the extracting machine along the underwater quarry and for hydraulic transportation of the recovered materials.

In still another embodiment of the invention, the working medium is constituted by a liquid. To create a positive buoyancy, the specific gravity of the liquid should be lower than that of water while for increasing the adhesion of the machine supports to the bottom soil the specific gravity of the working medium may in some cases be higher than that of water.

The invention provides for the movement of the machines from land, e.g. for loading the machine from the shore for which purpose the containers can be extended, beyond the supports. When the working liquid is fed into the containers this will displace the center of gravity of the machine beyond the limits of the support thus creating the moment required for lifting the machine together with the support then turning it in the required direction relative to one of the supports.

Additionally, moving on land the machine will be able to perform other operations, such as load handling.

The containers can be extened or retracted to the initial position by various telescopic mechanisms, e.g. power cylinders secured to the frame.

The compactness of the machine and the reduction of its weight can be achieved by employing inflatable containers of an elastic material.

When the machine is operated predominantly in the zone of wave and wind loads, the release of pressure in the inflatable container for building up a negative buoyancy may result in bursting of the inflatable shells. Therefore, there is a provision for making containers of at least two shells, i.e. outer and inner ones, the space between them communicating with a source of the working medium. In this case, the outer space will be subjected to a constant pressure and thus protect the shells against bursting. The spaces may be filled either with the same medium, i.e. gas, or with different media, e.g. gas and water.

Now the invention will be described in detail by way of example with reference to accompanying drawings, in which.

Figure 1:
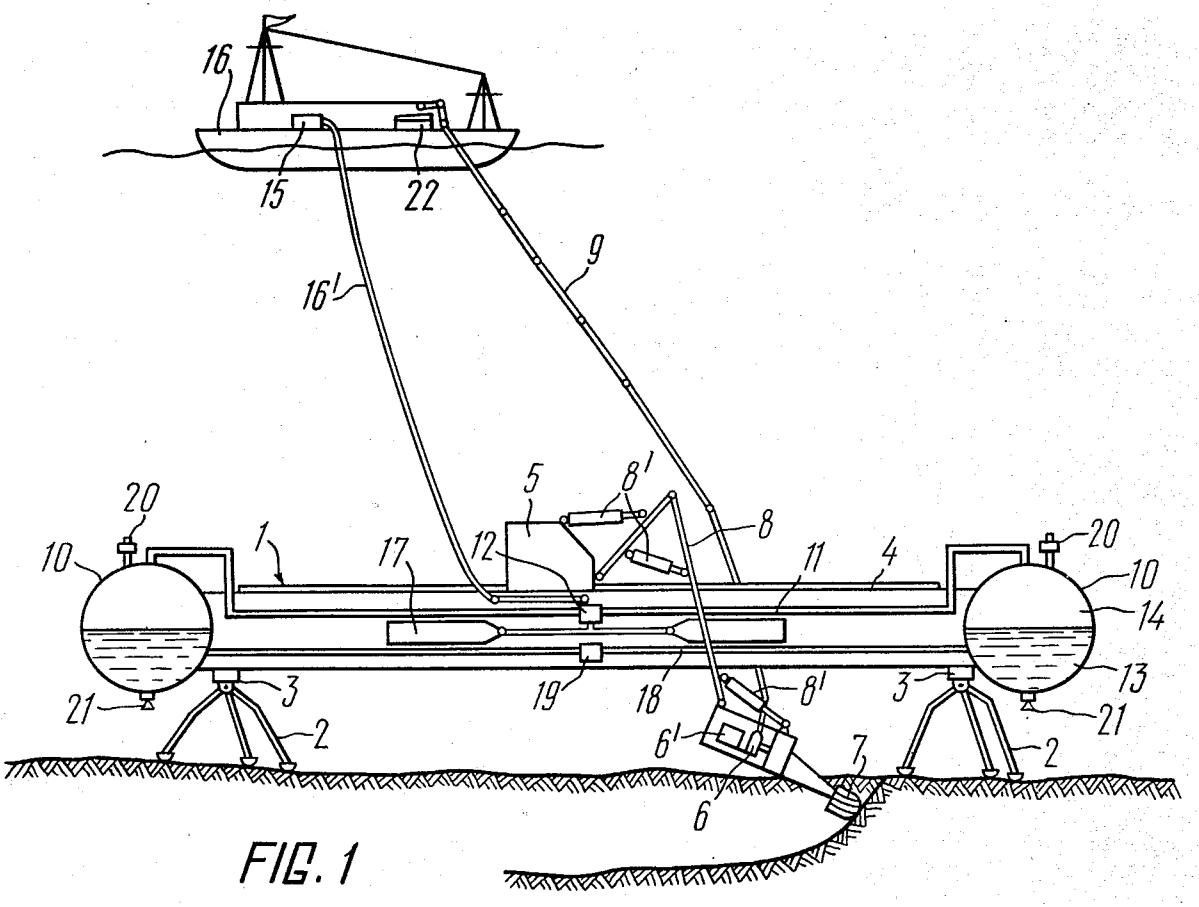
FIG. 1 is a schematic longitudinal section of the machine according to the invention.

The machine for extracting mineral deposits is shown in FIG. 1. It consists of a frame 1 with supports 2 and mechanisms 3 for turning the frame relative to said supports 2. The mechanism 3 can be made in the form of a swivelling cam drive which connects the frame 1 with the supports and is articulated to said mechanism 3. The turning mechanism 3, can be made in the form of screw or jet propelling elements fixed to the frame 1.

The frame is provided with guides 4 for the movement of a carriage 5. The carriage 5 supports the working devices, i.e. a slush pump 6 with a drive 6' for pumping mineral deposits in the form of a hydraulic mixture to the concentration devices, and a soil-intake element 7 for loosening and sucking in mineral deposits, said element 7 being mounted on a suspension 8 consisting of articulated links connected with power cylinder 8'. The suspension 8 provides for an optimum trajectory of movement of the soil-intake element 7. The slush pump 6 is connected with a hydraulic-transport pipe 9.

The machine has containers 10 in the zone of the supports 2. The containers 10 may be an integral element of the frame 1 and be different in shape.

The containers 10 are interconnected by a pipe 11 provided with a control valve 12, e.g. of the electromagnetic type, through which the working medium (liquid 13 or gas 14) is admitted into the containers 10. In one of the versions gas 14 can be delivered from a source 15 located on board the service vessel 16 through a hose 16'. In another embodiment the working gas 13 can be delivered from compressed gas cylinders 17 located in the frame 1 for the purpose of making the device self-contained or for emergency supply.

The containers 10 are also connected by equalizing pipes 18 with a pump 19 which transfers the liquid from one container 10 into the other.

Installed in the upper part of the containers 10 are gas-release valves 20 while their lower part is provided with valves 21 for letting the outside water in and out. The containers 10 can be open underneath which dispenses with the need for valves 21.

The recovered mineral is delivered from the slush pump 6 through the pipe 9 either to the receiving and concentrating plant 22 of the service vessel 16 or into other transport devices including underwater ones.

The working medium can be constituted by gases and liquids whose specific gravity is lower than that of water, e.g. the products of oil-refining or gas and liquid or by those whose specific gravity is higher than that of water, e.g. tetrabromoethane, mercury.

The machine is provided with a control unit (not shown) which can be mounted either on the service vessel 16 or on the carriage 5 of the machine.

The machine according to the invention operates as follows.

Figure 2:
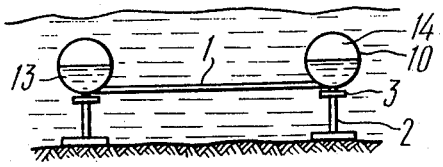
FIG. 2–6 show the operation of the machine according to the invention.
Figure 3:
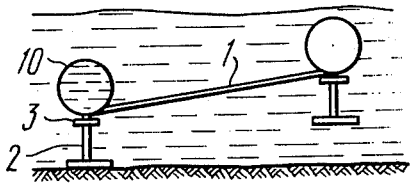
Figure 4:
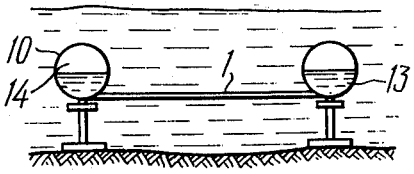
Figure 5:
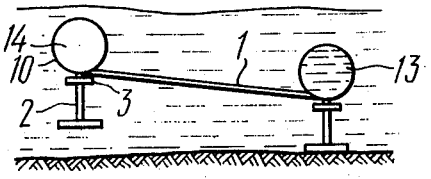
Figure 6:
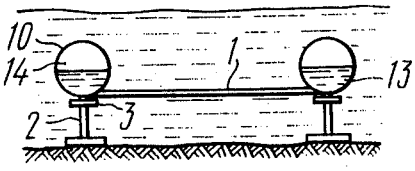
Figure 7:
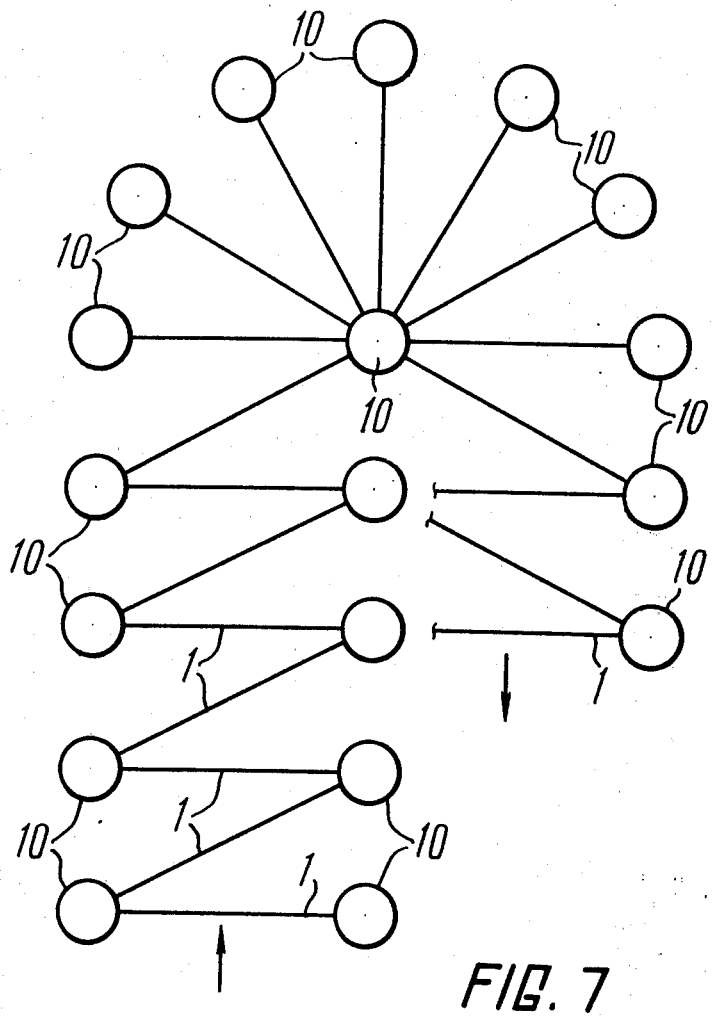
FIG. 7 shows in plan view the trajectories of the machine moving over the bottom.

The machine can be either carried to the zone of operation on board the service vessel 16 or towed in the water. For towing afloat the carriage 5 together with the slush pump 6, the soil-intake element 7 and suspension 8 is fixed on the frame 1 in the center of the machine (FIG. 1). The valves 20 and 21 are adjusted to set such a level of the liquid 13 in the containers 10 as to provide the requisite buoyancy and stability of the machine afloat. As the machine arrives at the working zone, the air is released from the containers 10 through the valves 20 and the outside water is pumped in through the valve 21 thus building up a negative buoancy for submerging the machine into the bottom. The machine is lowered on the bottom gently by the use of the known ballasting methods such as those used in submarines or submersible platforms. After placing the machine at the required position on the bottom, the extracting elements recover the minerals from the mineral streak after which the machine is moved from the initial position (FIG. 2) to a new position. When the machine is operated with the closed volume of the liquid 13, the control unit sends a command to the valve 12 to deliver gas 14 from the source 15 through the hose 16' into a container, e.g. right-hand one. In this case liquid 13 is transferred from the R.H. container 10 into the L.H. one either by the pump 19 or is forced out by the gas 14 delivered from the source 15. The gas 14 fills the R.H. container and the liquid flows into the L.H. container 10 for which purpose the valve 20 of the latter must be open. As soon as the required volume of liquid 13 is forced out of the R.H. container 19, the latter acquires a positive buoyancy and the device together with the R.H. support 2 rises above the surface of the bottom (FIG. 3). The machine is turned by the mechanism 3 through the preset angle (FIG. 7) after which the gas pressure in the R.H. and L.H. containers 10 is equalized with the aid of the valve 12, the pump 19 transfers the liquid from the L.H. container 10 into the R.H. one until a negative buoyancy is created in it and the R.H. support descends to the bottom surface (FIG. 4). The L.H. support 2 is lifted, turned and lowered in the same sequence (FIGS. 5, 6). After taking the new position, the machine works on the new mineral streak. Depending on the trajectory of the machine (FIG. 7) the latter can be lifted and turned relative to one of the supports 2 several times in succession.

If compressed gas 14 is used as a working medium, the valve 21 can be kept constantly open. In this case, gas 14 is delivered into the container 10 to force out water from it until said container 10 acquires the positive buoyancy required for lifting and turning the machine relative to the support 2; a negative buoyancy in the same container 10 is created by releasing gas 14 through the valve 20 in which case the outside water enters the container 10 through the constantly open valve 21.

In such a mode of operation, the pressures inside and outside the container 10 are equal and the walls of the containers 10 may have a minimum thickness.

In one of the embodiments of the present invention (FIG. 8), the containers 10 can be installed in guides 23 and can be moved out beyond the limits of the supports 2 by telescopic mechanisms, e.g. power cylinders 24, secured on the frame 1 of the machine. In this case the pipes 11 and 18 should be made of an elastic material or be of a telescopic construction.

This embodiment operates as follows.

Figure 8:
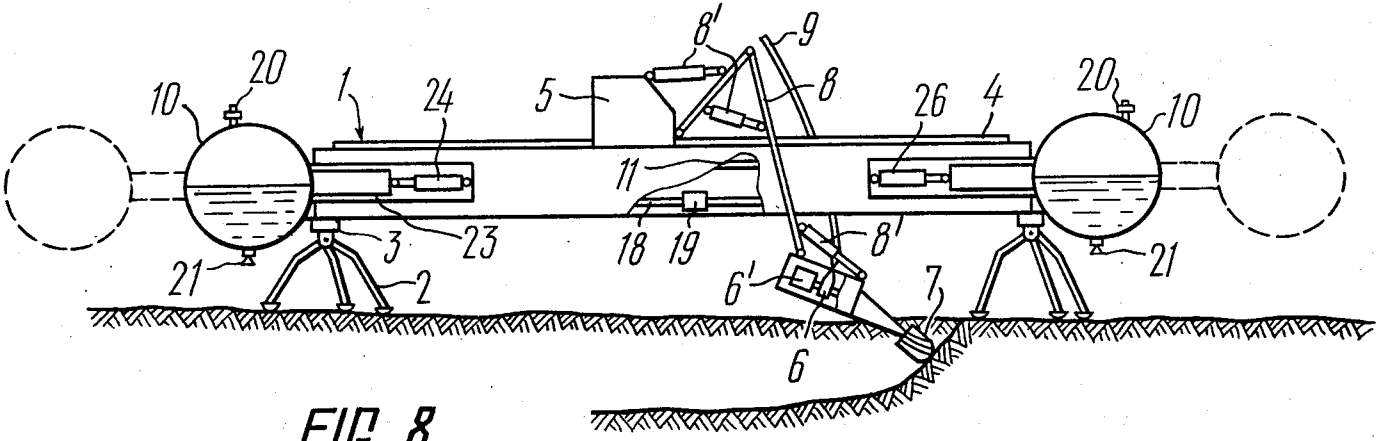
FIG. 8 is a longitudinal section of another embodiment of the machine.

When the machine is kept on the shore, containers 10 are filled with equal volumes of liquid 13 and gas 14 (FIG. 8). To lift the machine relative to one of its supports 2, the entire volume of liquid 13 is pumped from one container 10 into the other container 10 located in the zone of the opposite support; this container 10 completely filled with water is moved out by the power cylinder 24 to a position shown by dotted lines which creates a tilting moment and the machine is lifted at the opposite support 2. The mechanism 3 turns the machine through the preset angle, the containers 10 are put in communication with each other through the valve 12, the liquid is transferred by the pump 19 into the lifted container 10 and the lifted support descend to the bottom surface. Similar operations are performed on the other container 10 for lifting and turning the machine relative to the other support 2.

The machine can travel on land and in a coastal zone with the containers 10 (FIG. 8) extended beforehand to the extreme positions. In ths case the tilting moment is created only by transferring liquid from one container 10 into the other by the pump 19.

Figure 9:
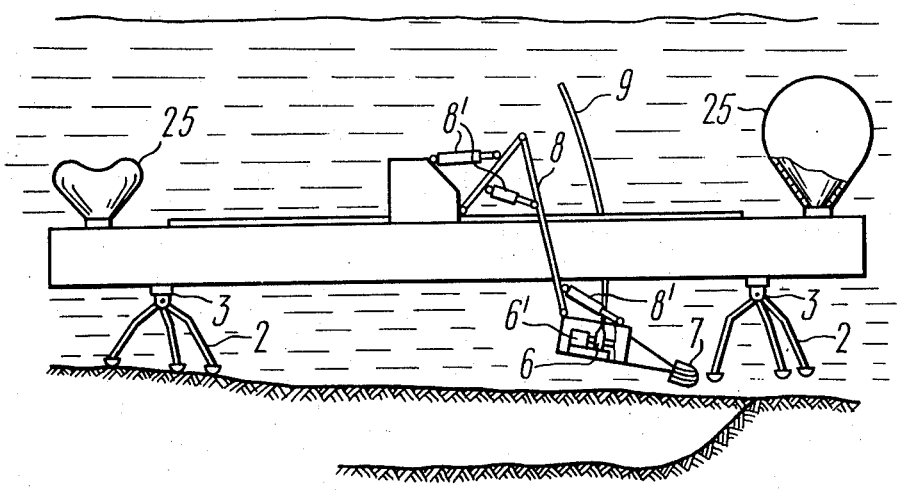
FIG. 9 is a longitudinal section of still another embodiment of the machine.
Figure 10:
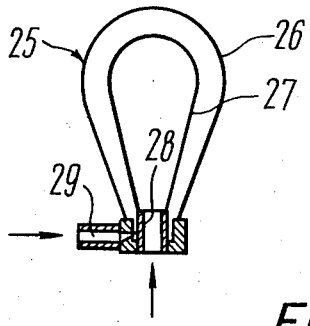
FIG. 10 shows in section an elastic container consisting of two shells.

In one of the embodiments of the invention the weight and size of the machine can be reduced by making the containers 25 (FIG. 9) from an elastic material, e.g. cord-reinforced rubber.

When the containers 25 are made from an elastic material, gas is delivered into one of them for lifting the machine relative to one of the supports 2. As the container 25 is filled with gas to the required volume, it acquires a positive buoyancy and the machine with the support 2 rises above the bottom. After the machine turns through the preset angle, the gas is released from the container 25 and the machine comes down into the bottom surface.

When the machine is operated in the zone of wave and wind loads, mostly in shallow water, a release of pressure in the inflatable container may lead to its mechanical damage. Therefore, the containers 25 can be made of two separately inflated elastic shells: namely an outer shell 26 and any inner shell 27 which form spaces communicating with the source of the working medium through pipes 28 and 29.

The space formed by the shells 26, 27 can be filled with the same working medium, e.g. a gas for maintaining a constant shape of the outer shell 26 and building up a positive buoyancy of the container 25, or with different media; thus, the outer space can be filled with gas and the inner one with liquid for creating a negative buoyancy of the container 25. If mixing of the working media is ruled out due to, say, a explosion hazard, the containers 25 have to be made of several shells.

For lifting all the embodiments to the surface, positive buoyancy is created in both containers 10, 25 and the machine rises to the surface.

What is claimed is:

1. A method for moving an object on the bottom of a body of water, said method comprising formig hollow members at opposite ends of the object, providing a total negative buoyancy in said hollow members to cause the object to rest on the bottom of the body of water via spaced supports on the object, producing a positive buoyancy in one of the hollow members to raise the associated end of the object above the bottom of the body of water, turning the object around the other said support to orient the object in a given direction, producing a negative buoyancy in said one hollow member to lower said associated end of the object until the object now again rests on both supports on the bottom of the body of water.

2. A method as claimed in claim 1 comprising producing a negative buoyancy in the other said hollow member to raise the associated end of the object above the bottom of the body of water while said end associated with said one hollow member rests on the bottom via the respective support, turning the object around said one support to orient the object in a given direction, producing a negative buoyancy in said other hollow body to lower the associated end of the object until it now rests again with both supports on the bottom of the body of water.

3. A method as claimed in claim 2 wherein alternation of movement of the ends of the object is effected so that the object walks on the bottom of the body of water.

4. A method as claimed in claim 2 wherein the negative buoyancy is effected by introducing a gas into the associated hollow member.

5. A machine for travel on the bottom of a body of water, said machine comprising a frame, first and second spaced supports respectively pivotably connected to said frame to turn in at least two planes, first and second container means on said frame in the region of each support, means for introducing a working medium into each said container means for selectively producing positive and negative buoyancy such that forces can be applied to the frame to lift and lower the associated support from and onto the bottom of the body of water, and means for turning the frame about one support while the other support is raised above the bottom of the body of water.

6. A machine as claimed in claim 5 comprising telescoping means supporting the container means from said frame for retracting and extending the same to change the center of gravity of the machine.

7. A machine as claimed in claim 6 wherein said telescoping means comprises a power cylinder.

8. A machine as claimed in claim 5 wherein said container means is made from an elastic material and is inflatable.

9. A machine as claimed in claim 9 wherein said container means comprises inner and outer shells defining an intermediate space, said means for introducing working medium into the container means being connected to said intermediate space.

10. A machine as claimed in claim 5 comprising tool means connected to said frame for operating underwater.

11. A machine as claimed in claim 5 comprising conduit means connecting the first and second container means for flow of working medium therebetween.

12. A machine as claimed in claim 11 comprising second conduit means connecting the first and second container means for flow of water therebetween.

13. A machine according to claim 5 wherein the working medium is constituted by a gas.

14. A machine according to claim 5 wherein the working medium is constituted by a liquid whose specific gravity is less than that of water.

* * * * *